US006851541B1

(12) United States Patent
Howells

(10) Patent No.: US 6,851,541 B1
(45) Date of Patent: Feb. 8, 2005

(54) DISCRIMINATOR FOR BIMETALLIC COINS

(75) Inventor: Geoffrey Howells, Near Salisbury (GB)

(73) Assignee: Scan Coin Industries AB, Malmo (SE)

( * ) Notice: Subject to any disclaimer, the term of this patent is extended or adjusted under 35 U.S.C. 154(b) by 0 days.

(21) Appl. No.: 09/582,961

(22) PCT Filed: Jan. 26, 1999

(86) PCT No.: PCT/SE99/00103

§ 371 (c)(1),
(2), (4) Date: Oct. 12, 2000

(87) PCT Pub. No.: WO99/39311

PCT Pub. Date: Aug. 5, 1999

(30) Foreign Application Priority Data

Jan. 30, 1998 (SE) ..... 9800284

(51) Int. Cl.[7] ..... G07D 5/08
(52) U.S. Cl. ..... 194/317; 324/222
(58) Field of Search ..... 194/317; 324/222; 73/514.14; 702/38

(56) References Cited

U.S. PATENT DOCUMENTS

| | | | | | |
|---|---|---|---|---|---|
| 4,235,707 | A | * | 11/1980 | Burke, Jr. | 209/3 |
| 4,601,380 | A | * | 7/1986 | Dean et al. | 194/318 |
| 4,625,166 | A | * | 11/1986 | Steingroever et al. | 324/223 |
| 5,199,545 | A | | 4/1993 | Takamisawa et al. | 194/319 |
| 5,353,906 | A | * | 10/1994 | Takamisawa et al. | 194/319 |
| 5,452,785 | A | | 9/1995 | Iwamoto et al. | 194/318 |
| 5,458,225 | A | * | 10/1995 | Iwamoto et al. | 194/318 |
| 5,489,015 | A | * | 2/1996 | Wood | 194/318 |
| 5,630,494 | A | * | 5/1997 | Strauts | 194/317 |
| 5,662,205 | A | * | 9/1997 | Levasseur | 194/317 |
| 5,743,373 | A | * | 4/1998 | Strauts | 194/318 |
| 5,833,042 | A | * | 11/1998 | Baitch et al. | 194/317 |
| 6,068,102 | A | * | 5/2000 | Kawase | 194/317 |
| 6,196,371 | B1 | * | 3/2001 | Martin et al. | 194/317 |
| 6,398,001 | B1 | * | 6/2002 | Hutchinson et al. | 194/317 |

FOREIGN PATENT DOCUMENTS

| | | | | |
|---|---|---|---|---|
| EP | 0639288 | | 2/1995 | G07F/3/02 |
| GB | 2135095 | | 8/1984 | G07D/5/08 |
| JP | 62265561 | A * | 11/1987 | 324/222 |
| JP | 04012266 | A * | 1/1992 | 324/222 |

* cited by examiner

*Primary Examiner*—Donald P. Walsh
*Assistant Examiner*—Jeffrey Shapiro
(74) *Attorney, Agent, or Firm*—James Ray & Associates

(57) ABSTRACT

A coin discriminator has a coin path along which a coin, containing a first portion and a second portion made of different metals and/or metal alloys, is arranged to pass. An electrical mechanism supplies time-varying drive signals to the coil mechanism. A detection mechanism detects eddy currents induced in the coin by the coil mechanism. The coil mechanism is arranged to induce in the coin an eddy current loop, which in a predetermined region of the coin crosses a bond between the first and the second portions of the coin.

16 Claims, 1 Drawing Sheet

DISCRIMINATOR FOR BIMETALLIC COINS

TECHNICAL FIELD

The present invention relates to a coin discriminator, comprising: a coin path along which a coin containing a first and a second portion made of different metals and/or metal alloys is arranged to pass; coil means positioned adjacent to the coin path; electrical means for supplying time varying drive signals to the coil means; and detection means for detecting eddy currents induced in the coin by the coil means. Furthermore, the present invention relates to a method of measuring the conductivity at a bond between the first and second portions of such a coin.

DESCRIPTION OF THE PRIOR ART

Coin discriminators, which are arranged to measure the electric characteristics, e.g. the resistance or conductivity, of a coin by exposing it to a magnetic pulse and detecting the decay of eddy currents induced in the coin, are generally known in the technical field. Such coin discriminators are used in a variety of coin handling machines, such as coin counting machines, coin sorting machines, coin validators for vending and gaming machines, etc. Previously known coin handling devices are for instance disclosed in WO 97/07485 and WO 87/07742.

The way in which such coin discriminators operate is described in e.g. GB-A-2 135 095, in which a coin testing arrangement comprises a transmitter coil, which is pulsed with a rectangular voltage pulse so as to generate a magnetic pulse, which is induced in a passing coin. The eddy currents thus generated in the coin give rise to a magnetic field, which is monitored or detected by a receiver coil. The receiver coil may be a separate coil or may alternatively be constituted by the transmitter coil having two operating modes. By monitoring the decay of the eddy currents induced in the coin, a value representative of the coin conductivity may be obtained, since the rate of decay is a function thereof.

Prior art coin discriminators often employ a small coil with a diameter smaller than the diameter of the coin. The coil induces and detects eddy currents in an arbitrary point of the coin (the actual part of the coin which is subject to the conductivity measurement above will vary depending on the orientation, speed, angle, etc., of the coin relative to the coil). This approach is sufficient for a normal homogeneous coin made of a single metal or metal alloy.

However, in recent years bimetallic coins have been issued on the market in different countries. A well known example of a bimetallic coin is the French 10 Franc.

Furthermore, some of the Euro coins to be issued within the European Community within a near future are planned to be of a bimetallic type.

Bimetallic coins are made as follows. Outer rings and central discs are punched from sheets (also known as blanks) of the two metal or metal alloys, of which the bimetallic coin is to be made. The disc is then fitted into the ring, and the coin is minted. Minting consists of pressing the coin between two hardened dies. The dies stamp the head and tail pattern onto the coin and also force the disc and ring together. The joint between the disc and ring is called a bond.

If the disc and ring are clean and free from oxide, the bond between the metals will have near zero electrical resistance. Ideally, the resistance of the metals or alloys is much greater than the resistance across the bond. However, if the ring or the disc is covered in an oxide layer before minting, the resistance of the bond will be greater than the resistance of the metals or alloys. Thus, by controlling the handling and storage conditions of the blanks between punching and minting, it is possible to control the bond resistance (or, alternatively, the conductivity, which is basically the inverse of resistance) in the finished bimetallic coin.

To control the resistance of the bond in this way may be particularly desired as an anti-fraud measure. At the production coins with too low or too high resistance will not be issued. To make such a controlled production practical, a method of repeatedly measuring the bond resistance of large volumes of coins would be required.

The prior art coin discriminators described above fail to provide a sufficiently accurate determination of the bond resistance or conductivity, since the measurement results obtained would vary to a large extent depending on the actual spot of measurement on the coin. In other words, if the conductivity for a given coin would happen to be measured in a spot located in the ring, the measurement results would differ from the results obtained if the measurement would take place in the disc. Furthermore, if the measurement spot would embrace a portion of the bond between the ring and the disc, yet another measurement result would be obtained. A coin discriminator according to the prior art is cited in the introductory part of claim 1.

SUMMARY OF THE INVENTION

It is therefore an object of the present invention to allow repeatable and accurate determination of the bond conductivity or resistance in a coin comprising a first and a second portion made of different metals or metal alloys, e.g. a bimetallic coin.

The object is achieved for a coin discriminator, comprising: a coin path along which a coin is arranged to pass; coil means positioned adjacent to the coin path; electrical means for supplying time varying drive signals to the coil means; and detection means for detecting eddy currents induced in the coin by the coil means, by arranging the coil means so that an eddy current loop is induced in the coin in such a way that it crosses, in a predetermined region of the coin, the bond between the first and second portions of the coin.

Furthermore, the object above is achieved through a method of measuring the conductivity at the bond between the first and second portions of the coin, wherein the coin is subjected to a magnetic field by coil means external to the coin and wherein eddy currents induced in the coin are detected by detection means external to the coin, the magnetic field being generated such that a loop of eddy currents crosses the bond in a predetermined region of the coin.

The solutions described above are defined by the appended independent patent claims. Preferred embodiments of the invention are the subject of dependent claims.

BRIEF DESCRIPTION OF THE DRAWINGS

The invention will now be described in more detail, reference being made to the accompanying drawing, in which.

DETAILED DESCRIPTION

Figure 1:
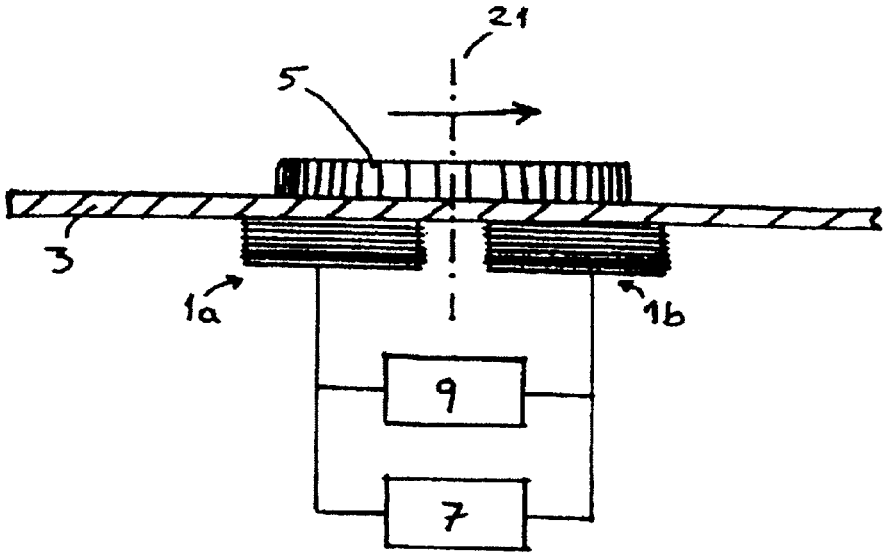
FIG. 1 is a schematic sectional view of a coin discriminator according to a preferred embodiment of the invention.

As shown in FIG. 1 the coin discriminator comprises a coil means in the form of two coil portions 1*a* and 1*b*, which are connected to an electrical device 7 for supplying voltage pulses thereto. Furthermore, the coin discriminator comprises detection means 9 for detecting eddy currents induced in the coin by the magnetic pulses generated by the coil means in response to the voltage pulses supplied from the electrical means 7. The coil means 1*a*, 1*b* acts as a transmitter coil for exposing a bimetallic coin 5, which is moved past the coin discriminator along a 1 mm thick ceramic plate 3 in a direction indicated by an arrow, to a magnetic pulse giving rise to eddy currents in the coin 5, and furthermore the coil means acts as a receiver coil for detecting the magnetic field variations generated by the eddy currents in the coin 5 and converting them into a corresponding voltage signal.

Figure 3:
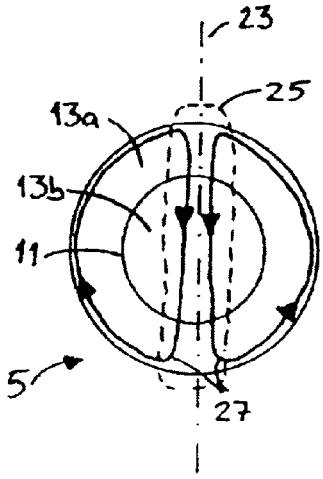
FIG. 3 is a schematic illustration of a bimetallic coin and the eddy currents generated therein by the coin discriminator of FIGS. 1 and 2.

As shown in FIG. 3, the coin 5 comprises a ring 13*a* of a first metal or alloy and a disc 13*b* of a second metal or alloy. A bond between the disc 13*b* and the ring 13*a* is labelled 11. The detection device 9 is arranged to measure the decay of these eddy currents and produce a value of the bond conductivity or resistance in response thereto. As will be described below, the coin discriminator is arranged to carry out the conductivity measurements when the center of the coin 5 is aligned with a center plane 21 of the coin discriminator.

Figure 2:
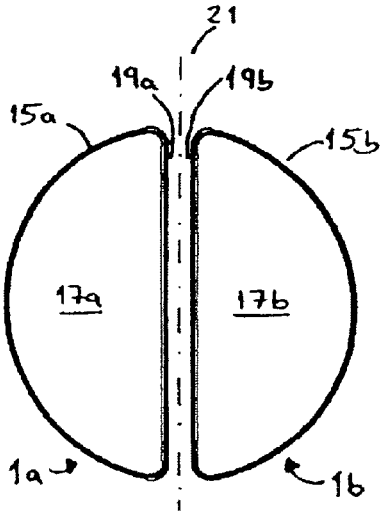
FIG. 2 is a schematic top view of the arrangement in FIG. 1.

As seen in FIG. 2, the coil means 1*a*, 1*b* comprises a first and a second coil frame 17*a*, 17*b*, which are provided with a respective first and second winding 15*a*, 15*b*. The coil frames 17*a*, 17*b* have an essentially semi-circular sectional shape and are symmetrically arranged at either sides of the coil center plane 21. The distance between the coil frames 17*a* and 17*b* is about 5 to 10 mm, and the radius of each semi-circular section is about 10 to 20 mm. An electrical conductor is wound on the coil in an equal number of turns on each coil frame 17*a*, 17*b*. For instance, a polyurethane covered copper wire with an internal diameter of 0.2 mm and an external diameter of about 0.25 mm may be used as the electrical conductor forming the windings 15*a*, 15*b* on the coil frames 17*a*, 17*b*. Preferably, each winding contains 10 to 100 turns, and furthermore one winding 15*a* is wound clockwise, while the other winding 15*b* is wound counterclockwise, for reasons set out below.

The adjacent portions 19*a* and 19*b* of the two halves 1*a*, 1*b* of the coil contain winding wires, which run essentially parallel to each other and are symmetrically arranged with respect to the coil plane 21. Furthermore, since the windings 15*a*, 15*b* are formed by one single contiguous conductor, a common electric current will flow through the entire windings 15*a*, 15*b*, when driven by a voltage pulse from the electrical means 7. In response thereto, a pulsed magnetic field will be generated around the windings 15*a*, 15*b*. In the central region of the coil, i.e. around the adjacent portions 19*a*, 19*b* and the center plane 21, the current will flow in the same direction in both windings 15*a*, 15*b* and will hence cooperate in generating a magnetic field.

The bond conductivity is measured when the coin is in the middle of the coil, as shown in FIG. 1, i.e. when the diameter 23 (see FIG. 3) of the coin 5 is aligned with the center plane 21 of the coil 1*a*, 1*b*. The duration of the voltage pulses supplied by the electrical means 7 to the coil 1*a*, 1*b* may be chosen in accordance with the actual application; however, a duration of 10 to 100 microseconds appears appropriate for most situations.

Thanks to the arrangement above an eddy current loop 27 is generated in the coin 5 along a path, which approximately corresponds to the wire pattern of the two windings 15*a*, 15*b* (i.e. the symmetric double semi-circular shape), as is schematically illustrated in FIG. 3. The exact shape of an eddy current loop generated in a coin is a complex subject, which is difficult to model mathematically. However, tests have indicated that the eddy current loop has a flow approximate to the one described below.

The coil illustrated in FIGS. 1 and 2 is intended to be used for coins with a diameter smaller than the diameter of the coil 1*a*, 1*b*. As a consequence the eddy current loop 27 generated in the coin 5 will have the shape shown in FIG. 3. At the central region 25 of the coin 5, i.e. in a region proximate to the diameter 23 of the coin, the eddy current loop 27 (or indeed the two eddy current loops 27) will run in parallel to the diameter 23 from a point at one side of the coin to a point at an opposite side of the coin. When the eddy current loop 27 reaches the circumference of the coin 5, the eddy current is forced to flow around the coin surface and eventually return to the first side of the coin. As a result the eddy current loop 27 will cross the bond 11 between the ring 13*a* and the disc 13*b* of the coin 5 twice during the way from the first side of the coin to the opposite side, i.e. along the diameter 23 of the coin 5. Thus, since the measurements take place when the coin 5 is aligned with the coil 1*a*, 1*b*, the detection of the eddy current loop 27 is bound to involve the bond 11, unlike the prior art approaches, which fail in this regard.

By the use of a coin discriminator according to the present invention it is possible to reduce the risk of forgeries, since the coin discriminator may be used during the production of the coins for sorting out such coins, the bond of which is found to have a resistance or conductivity, which falls outside predetermined limits. Preferably, the coin discriminator is operatively connected to storage means not disclosed in the drawing for storing predetermined maximum and minimum values of the bond conductivity or resistance for the current type of coin. After having measured the conductivity or resistance of the coin, the output of the detection device 9 is compared to the predetermined limits so as to determine whether the bond conductivity or resistance falls within an acceptable range, wherein the coin will be allowed to be issued, or does not fall within the acceptable range, in which case the coin will be prevented from being issued.

According to an alternative embodiment, the coin discriminator described above may be used for determining the authenticity of bimetallic coins already present on the market, by determining the bond conductivity or resistance thereof and comparing a detected value to predetermined limits.

The invention has been described above with reference to a few embodiment examples. However, embodiments other than the ones described above are possible within the scope of the invention, as defined by the appended independent patent claims. For instance, the coil means may be driven by electrical signals other than voltage pulses, such as sine waves or square waves. In order to generate the desired eddy currents in the coin, virtually any kind of time varying electric drive signals may be used, as will be readily realized by the skilled man.

Furthermore, the coil means may comprise more than two coil frames and windings. For instance, the coils means may be formed by four frames and windings, preferably symmetrically arranged about any coil center plane(-s).

What is claimed is:

1. A coin discriminator for a coin containing a first portion and a second portion made of at least one of different metals, metal alloys and combinations thereof, said coin discriminator comprising:

(a) a coin path along which said coin is arranged to pass;

(b) a coil means positioned adjacent said coin path;

(c) electrical means electrically connected to said coil means for supplying time varying drive signals to said coil means; and (d) detection means disposed in a position for detecting eddy currents induced in said coin by said coil means, said coil means being arranged to induce in said coin an eddy current loop, which in a predetermined region of the coin crosses a bond between the first and second portions of said coin, said coil means includes a first and a second coil frame, wherein said first and said second coil frame has an essentially semicircular sectional shape, and said first and said second coil frame are symmetrically arranged at either side of a coil center plane situated between said coil means.

2. The coin discriminator according to claim 1, wherein said predetermined region of said coin is proximate to a diameter of said coin.

3. The coin discriminator according to claim 1, wherein said first and said second coil frame of said coil means are provided with a first and a second winding, respectively, said windings being connected to said electrical means in such a way that flow of current in said first winding is parallel to and has a same direction as flow of current in said second winding in adjacent portions of said windings.

4. The coin discriminator according to claim 2, wherein said first and said second coil frame of said coil means are provided with a first and a second winding, respectively, said windings being connected to said electrical means in such a way that flow of current in said first winding is parallel to and has a same direction as flow of current in said second winding in adjacent portions of said windings.

5. The coin discriminator according to claim 3, wherein said first and said second coil frames are symmetrically arranged with respect to said coil center plane situated between said coil means, adjacent portions of said windings running essentially parallel to said coil center plane.

6. The coin discriminator according to claim 4, wherein said first and said second coil frame are symmetrically arranged with respect to said coil center plane situated between said coil means, adjacent portions of said windings running essentially parallel to said coil center plane.

7. The coin discriminator according to claim 3, wherein said first and said second windings include an equal number of turns of an electrical conductor, said number of turns preferably being a value between 10 and 100.

8. The coin discriminator according to claim 4, wherein said first and said second windings include an equal number of turns of an electrical conductor, said number of turns preferably being a value between 10 and 100.

9. The coin discriminator according to claim 7, wherein said winding of said first coil frame is wound clockwise and said winding of said second coil frame is wound counterclockwise.

10. The coin discriminator according to claim 8, wherein said winding of said first coil frame is wound clockwise and said winding of said second coil frame is wound counterclockwise.

11. A method of measuring conductivity at a bond between a first and a second portion of a coin, said coin including at least one of two different metals, metal alloys and a combination thereof, said method comprising the steps of:

(a) providing a coin discriminator apparatus comprising:

i. a coin path along which said coin is arranged to pass;

ii. a coil means positioned adjacent said coin path;

iii. electrical means electrically connected to said coil means for supplying time varying drive signals to said coil means;

iv. detecting means disposed in a position for detecting eddy currents induced in said coin by said coil means, said coil means being arranged to induce in said coin an eddy current loop, which, in a predetermined region of the coin crosses a bond between the first and second portions of said coin, said coil means includes a first and a second coil frame, wherein said first and second coil frame has an essentially semicircular sectional shape; and v. said first and second coil frame are symmetrically arranged at either side of a coil center plane situated between said coil means;

(b) inserting said coin into said discriminating apparatus;

(c) subjecting said coin to a magnetic field, external to said coin, using said discriminator;

(d) inducing in said coin a loop of eddy currents which cross said bond in said predetermined region of said coin using said discriminator; and (e) detecting said eddy currents induced in said coin, external to said coin, using said detecting means.

12. The method according to claim 11, wherein said method includes the additional steps of:

(a) comparing an output of said detecting means to a predetermined range of conductivity values; and (b) determining, based on a result of a comparison determined in step (a), whether said coin is authentic.

13. The method according to claim 11, wherein said method includes the additional steps of:

(a) comparing an output of said detecting means to a predetermined range of conductivity values; and (b) determining, based on a result of a comparison determined in step (a) whether a conductivity of said coin fulfills preset requirements.

14. The method according to claim 11, wherein said predetermined region where said eddy currents cross said bond is proximate to a diameter of said coin.

15. The method according to claim 14, said method further includes the steps of:

(a) comparing an output of said detecting means to a predetermined range of conductivity values; and (b) determining, based on a result of a comparison determined in step (a), whether said coin is authentic.

16. The method according to claim 14, said method further includes the steps of:

(a) comparing an output of said detecting means to a predetermined range of conductivity values; and (b) determining, based on a result of a comparison determined in step (a) whether a conductivity of said coin fulfills preset requirements.

* * * * *